US007555986B2

(12) United States Patent
Givens et al.

(10) Patent No.: US 7,555,986 B2
(45) Date of Patent: Jul. 7, 2009

(54) THERMITE CHARGE

(75) Inventors: Richard W. Givens, Columbus, OH (US); Jerome A. Klein, Raymond, OH (US); Thomas E. Burky, Monroe Township, OH (US); James J. Reuther, Worthington, OH (US)

(73) Assignee: Battelle Memorial Institute, Columbus, OH (US)

( * ) Notice: Subject to any disclaimer, the term of this patent is extended or adjusted under 35 U.S.C. 154(b) by 281 days.

(21) Appl. No.: 11/371,541

(22) Filed: Mar. 8, 2006

(65) Prior Publication Data

US 2006/0266204 A1 Nov. 30, 2006

Related U.S. Application Data

(60) Provisional application No. 60/659,677, filed on Mar. 8, 2005.

(51) Int. Cl.
*F42D 3/00* (2006.01)
*B23K 7/00* (2006.01)

(52) U.S. Cl. ..... 102/331; 102/293; 266/48; 148/194

(58) Field of Classification Search ..... 102/307, 102/331, 476, 314, 320, 321, 332, 293; 89/1.14; 266/48, 167; 148/194, 204, 205
See application file for complete search history.

(56) References Cited

U.S. PATENT DOCUMENTS

| | | | | |
|---|---|---|---|---|
| 4,216,721 | A * | 8/1980 | Marziano et al. | 102/306 |
| 4,815,384 | A * | 3/1989 | Ringel et al. | 102/307 |
| 4,996,922 | A * | 3/1991 | Halcomb et al. | 102/205 |
| 5,377,594 | A * | 1/1995 | Alford | 102/308 |
| 5,698,812 | A * | 12/1997 | Song | 102/364 |
| 5,936,184 | A * | 8/1999 | Majerus et al. | 89/1.13 |
| 6,183,569 | B1 * | 2/2001 | Mohler | 148/194 |
| 6,805,832 | B2 * | 10/2004 | Mohler et al. | 266/48 |
| 2003/0006538 | A1 * | 1/2003 | Mohler et al. | 266/74 |

* cited by examiner

*Primary Examiner*—James S Bergin
(74) *Attorney, Agent, or Firm*—MacMillan, Sobanski & Todd, LLC

(57) ABSTRACT

The present invention provides for cutting operations using linear thermite charges; the charges cut one dimensional or two dimensional geometric shapes; the invention is useful for structure entry or demolition.

15 Claims, 13 Drawing Sheets

THERMITE CHARGE

This application claims the benefits of U.S. Provisional Application No. 60/659,677 filed Mar. 8, 2005.

The entire contents of the provisional application are incorporated herein by reference.

FIELD OF THE INVENTION

The invention relates to thermite charges that are useful for cutting materials including metals, masonry, reinforced concrete, rock, and the like. The invention allows more expeditious and safer material removal, including entry into structures, and structural demolition.

BACKGROUND OF THE INVENTION

Thermite reactions are well characterized and have been used for a variety of applications, including demilitarization of expended ordnance, quick repair welding of railroad tracks, and cutting applications using lances or burning bars. The thermite reaction is an exothermic reaction that can produce temperatures of more than 4,000° F. These temperatures are well above the melting point of most metals. Boosting the rate of the thermite reaction by flowing a stream of oxygen through the materials can raise the reaction temperature from the normal 4,000° F. to the range of 10,000° F. to 16,000° F. Boosting the temperature to this level greatly reduces the time associated with cutting through a material. In addition, directing the burning particles and gases into a jet through a nozzle allows improved removal of molten metal and deeper penetration into the material.

Until this time, one-shot thermite-based devices have been used primarily to make point like, circular holes in materials. Sustained thermite cutting technologies, such as burning bars, achieve linear-shaped cuts by expanding on the initial penetrated area and moving away from the initial point of penetration in a line (similar to a conventional cutting torch). By configuring a single-use apparatus and its associated nozzle into a linear or curvilinear arrangement, the shape of the penetration would be lengthened dramatically. Connecting segments of these devices into a desired shape would allow users to determine the dimensions of a breach area or linear cut.

This thermite-based method will allow operators to penetrate a material in timeframes similar to explosive shape charges without the safety concerns and security risks associated with explosives. In addition, the sustained duration of a thermite jet will more effectively handle discontinuities and interfaces that normally disrupt and dissipate explosively driven shape charge jets. When a linear shaped charge is used for cutting steel on a steel bridge demolition project, a large degree of preparation work must be undertaken to ensure a successful cut or penetration. A "preconditioning" process involves removing overlapped plates and areas of reinforcement with a conventional cutting torch. This process is time consuming, expensive, and dangerous. Conversely, the sustained jet of a thermite charge offers improved performance over multi-plate materials with limited or substantially no preconditioning. The thermite charge's sustained jet also affords a greater assurance in cutting plates of varying thickness, layered plate configurations, and any supporting or reinforcing members that may exist in the middle or on the backside of a material. While the projected thermite charge particle stream is a slower reaction than that of an explosively driven jet, it is very fast from the perspective of the operator.

The anticipated timing for material penetration is typically on the order of hundreds of milliseconds.

BRIEF DESCRIPTION OF THE INVENTION

Broadly the invention provides for thermite charges to make linear or curvilinear cuts in materials such as building structures, pavements, transport equipment such as ships, planes, and the like. As used herein, the term linear includes both linear and curvilinear shapes. Typically, the term linear includes elongated jet shapes (described in more detail below) and is not limited by whether the elongated jet opening is linear, curvilinear, or has bends.

A first embodiment includes a linear thermite charge apparatus having an elongated casing; an elongated volume within the casing, wherein a thermite material can be disposed within the volume; and one or more linear nozzles in communication with the volume. Typically the volume in the elongated casing contains one or more thermite materials. In some embodiments the linear nozzle includes a plurality of nozzles in a linear array. In some embodiments extra cutting power is obtained by potassium permanganate ($KMnO_4$) and/or potassium ferrate ($K_2FeO_4$) disposed within the volume. in a preferred embodiment, one or more separators are disposed within the volume, wherein two or more compartments are formed within the volume. Typically at least one compartment comprises fuel and at least one compartment comprises oxidizer.

One embodiment includes kits with connectors to place one or more thermite charges for desired type of cuts. The connectors typically provide mechanical and electrical continuity (e.g. bolt, male/female). The kit typically includes a plurality of modular linear thermite charges; a plurality of connectors for connecting the charges and electrical wiring for firing an initiator disposed in each modular linear thermite charge; mounting mechanisms for mounting the modular linear thermite charges to a surface; stud drivers for mounting the modular linear charges to a surface; and an ignition system for firing the modular linear thermite charges with the wiring. A further embodiment includes a method for cutting a material buy the steps of providing a thermite charge including an elongated casing; an elongated volume within the casing, wherein a thermite material is disposed within the volume; and one or more linear nozzles in communication with the volume; placing the linear nozzle of the thermite charge against the surface; and firing the thermite charge to cut the material. Typically a plurality of linear charges are supplied and used to cut the material.

Another embodiment provides for enhanced safety for both storage and use by providing mixing (fuel and oxidizer) at time of firing the thermite charge.

A further embodiment provides for pre-mixed (fuel and oxidizer) formulations.

Another embodiment provides for gas generation via thermite in the applications disclosed herein.

A yet further embodiment provides for the generation of $O_2$, or other oxidative, gas to raise temperature of the jet emanating from the thermite charge thus enabling the cutting of concrete, reinforced concrete (to include the rebar), rock, masonry, and the like. This is typically accomplished by over oxidizing so that more oxygen is produced than is needed stoichiometrically by the reaction.

BRIEF DESCRIPTION OF THE DRAWINGS

FIG. 1C shows a cut material 10 with an abraded area 12 and a typical linear cut 13. FIG. 1D shows a cut material 20 with an abraded area 22 and an irregular elongated cut.

DETAILED DESCRIPTION OF THE INVENTION AND BEST MODE

Figure 11:
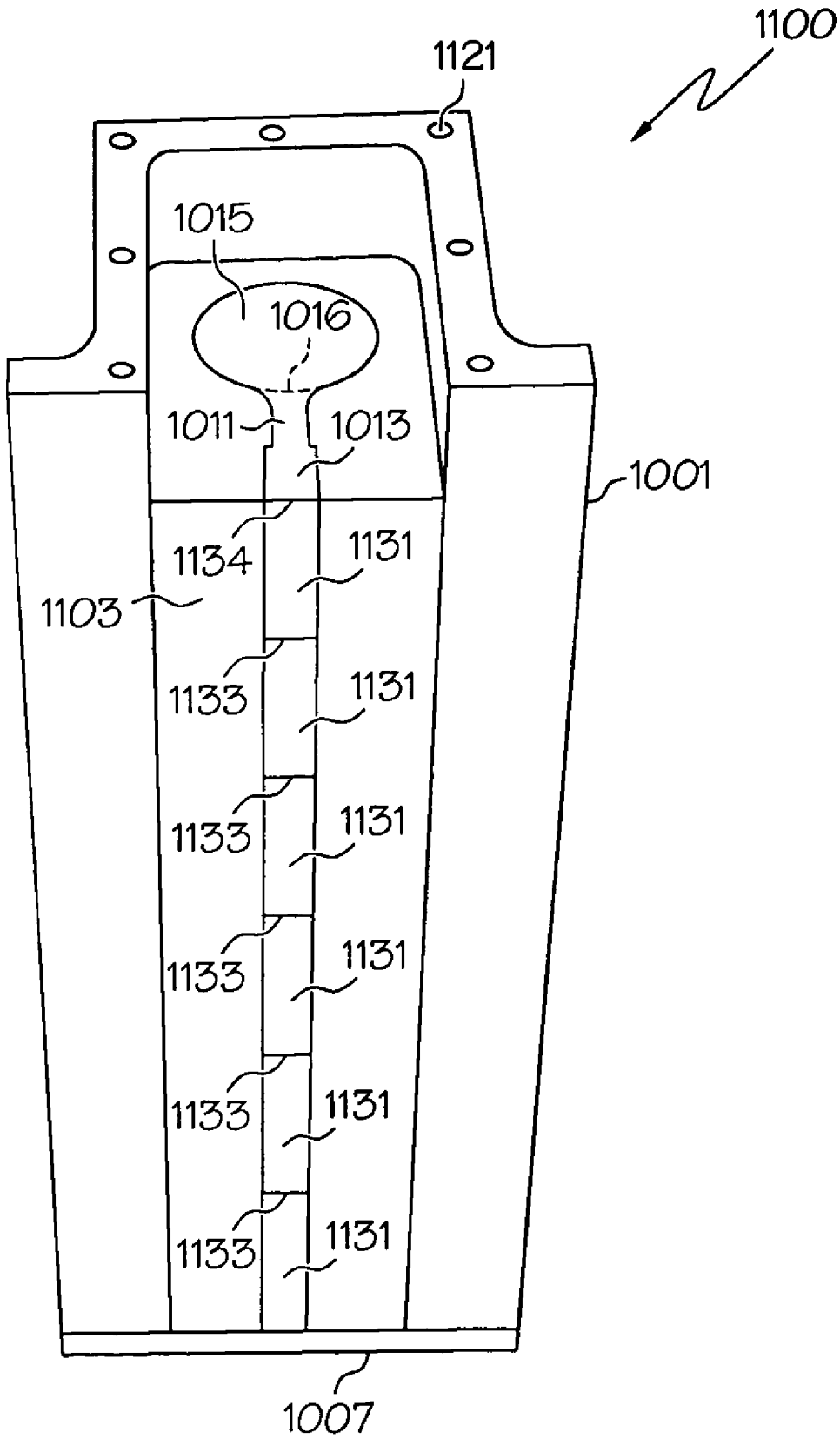
FIG. 11 is an oblique view of another embodiment of a linear thermite charge having a plurality of shorter elongated jets.
Figure 12:
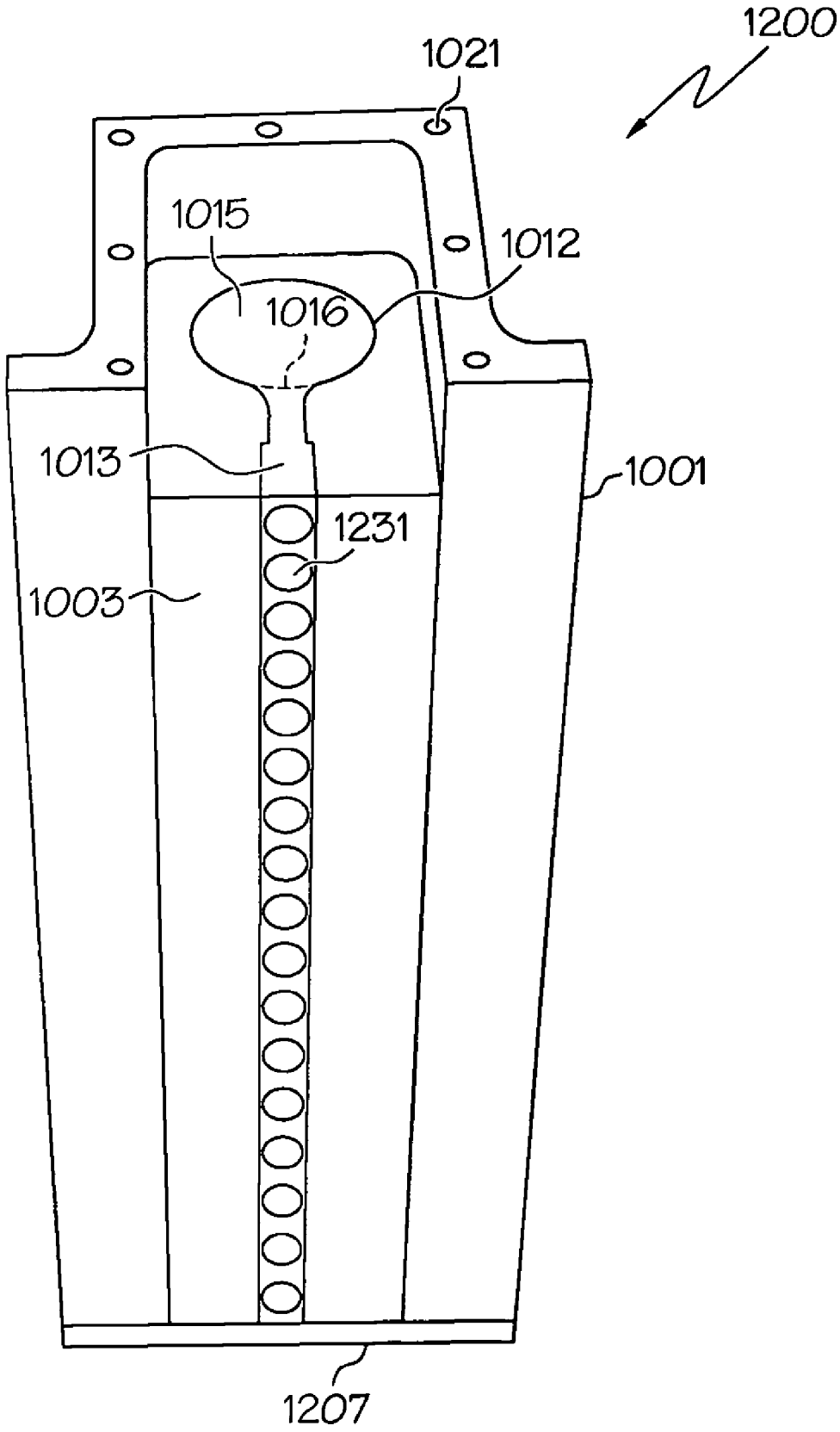
FIG. 12 is an oblique view of a yet further embodiment of a linear thermite charge having a plurality of circular shaped jets.

Broadly, the invention includes apparatus and methods of cutting materials using a linear, or curvilinear nozzle where the nozzle may be a long linear nozzle (see FIG. 10), an array of a series of elongated nozzles that may be rectangular or square (see FIG. 11), or an array of a series of circular nozzles (see FIG. 12). Hot reaction products (typically hot thermite reaction products) are ejected from the nozzle under pressure and erode, spall, oxidize or reduce a target material or materials. In some cases the hot reactants react with the target material or materials. The invention typically allows the cutting of very resistant materials including concrete and contained rebar (reinforced concrete) in a single step using a non-explosive, hot jetting material.

The materials used for the thermite reaction may be premixed or mixed immediately prior to being jetted into the target material. One method for mixing the materials is to fluidize one solid reactant (typically powders or granulates) with a pressurized oxidant, and feeding them into a reaction chamber. Another method includes mixing two or more solid reactants (typically powders or granulates) and feeding them into a reaction chamber with or without pressured oxidant. The materials react and form a jet. The cutting action of the thermite charge can be augmented by pressurizing it with an oxidizing gas (e.g. oxygen or air).

The apparatus and method typically provide for a reaction that provides cutting action in a non-explosive manner. "Non-explosive manner" is defined as a reaction that proceeds below the speed of sound in the reacting material. By proceeding below the speed of sound in the reacting material a shock wave as experienced in explosives is avoided.

Figure 1B:
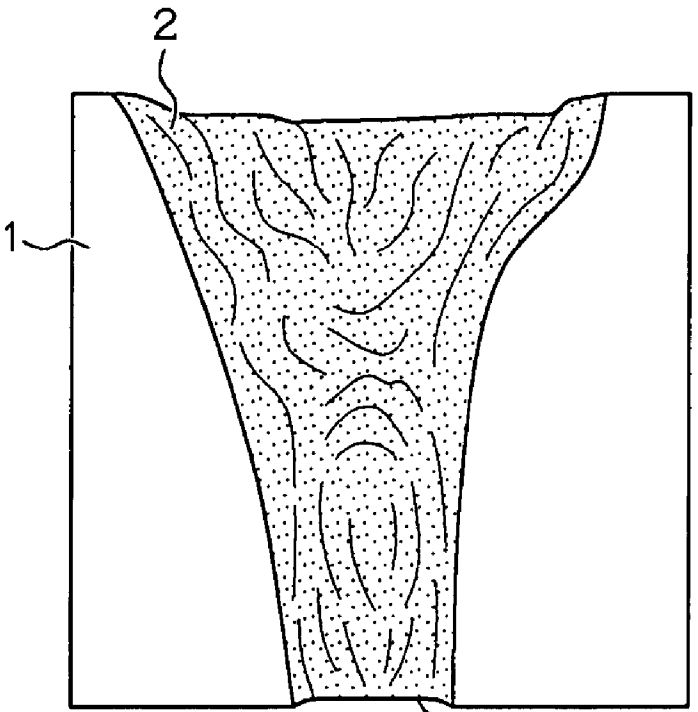
FIG. 1A illustrates a top view of a hole made by a single circular pressure driven thermite torch of circular shape on a 75 mm (3 inch) thick carbon steel material and FIG. 1B shows the side view. Material 1 is penetrated by a jet to form an abraded area 2 and a hole 3.
Figure 1A:
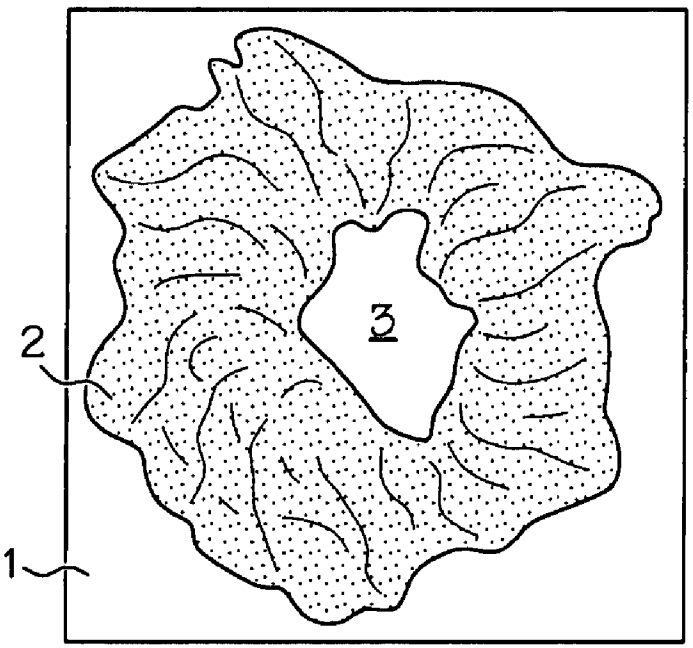
Figure 1D:
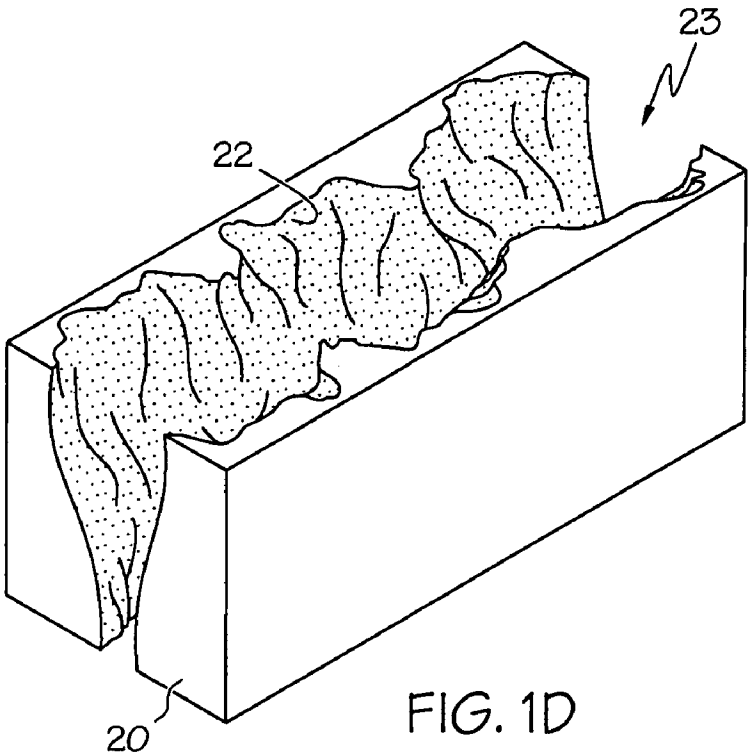
FIG. 1D illustrates an oblique view of a typical elongated hole or cut that can be made by a series of thermite jets according to another embodiment of the invention.
Figure 1C:
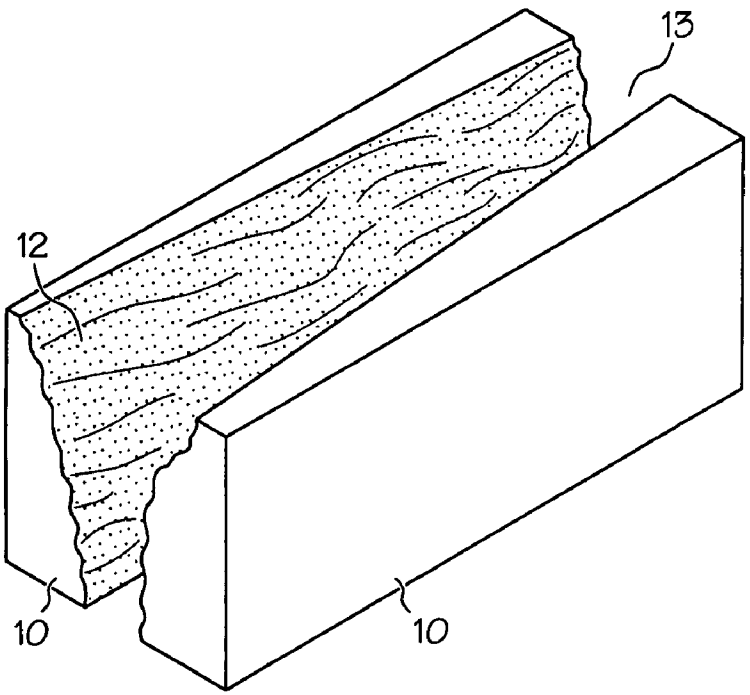
FIG. 1C is an oblique view of a typical elongated hole or cut that can be made by an elongated thermite jet according to the one embodiment of the invention.

It has previously been demonstrated that the effectiveness of focusing a high-temperature, thermite-produced jet through a nozzle will produce a hole. FIGS. 1A and 1B show the penetration achieved by a thermite torch of circular shape. A linear nozzle configuration will allow simultaneous cutting over an extended length. This is illustrated in FIGS. 1C and 1D. FIG. 1C would be the result of one large elongated jet or a series of shorter elongated jets while the cut shown in FIG. 1D is expected from a series of adjacent circular jets. Enhancing the velocity and temperature of these jets with an oxygen- and/or gas-producing compound increases the jets' efficiency and capability. Careful application and timing of overpressure to drive the jet is crucial for optimum performance.

Figure 2:
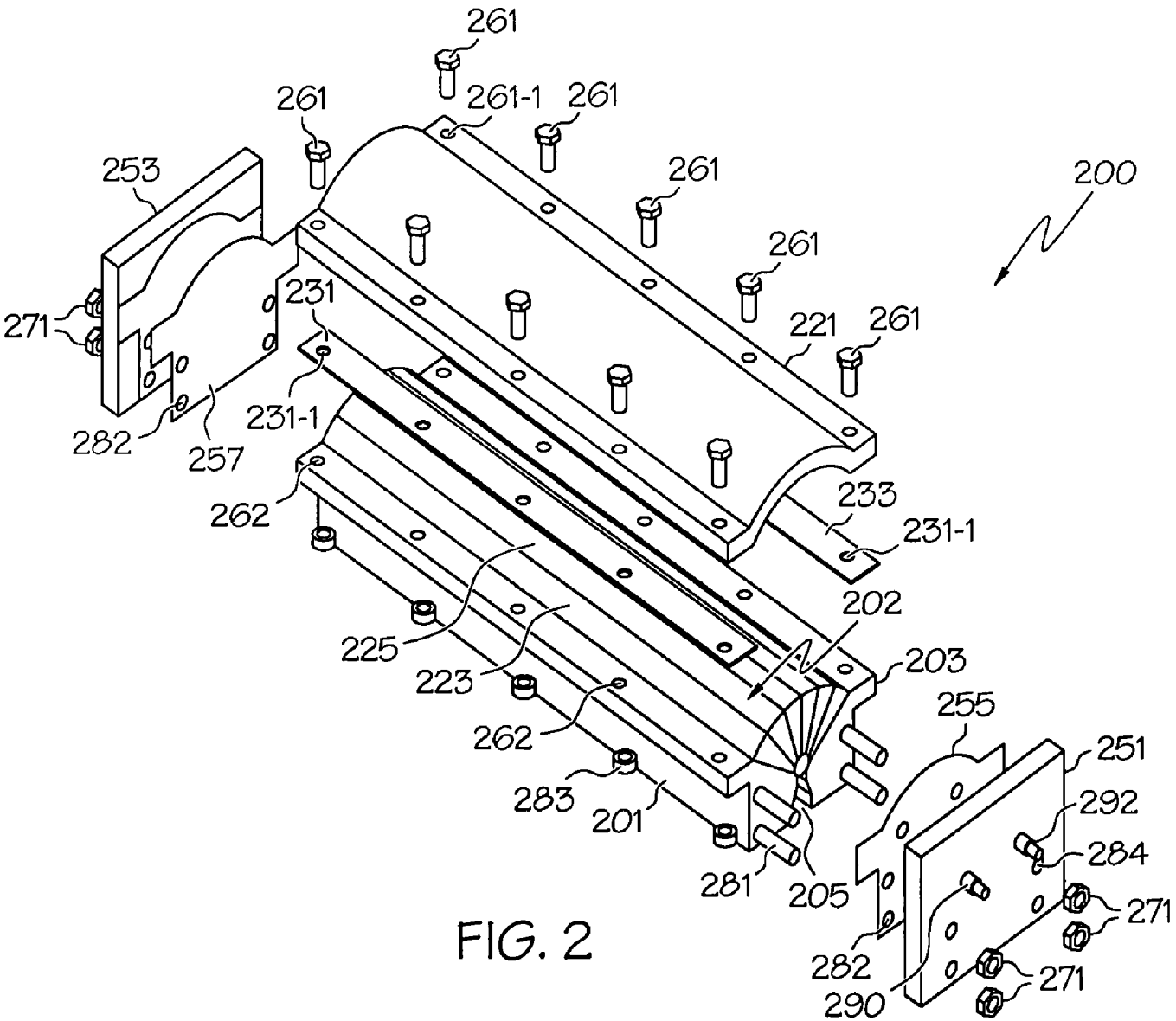
FIG. 2 illustrates one embodiment of the invention showing compartmentalized structure for a typical compartmented thermite charge that allows dry powder application of fuel and oxidizer.
Figure 3:
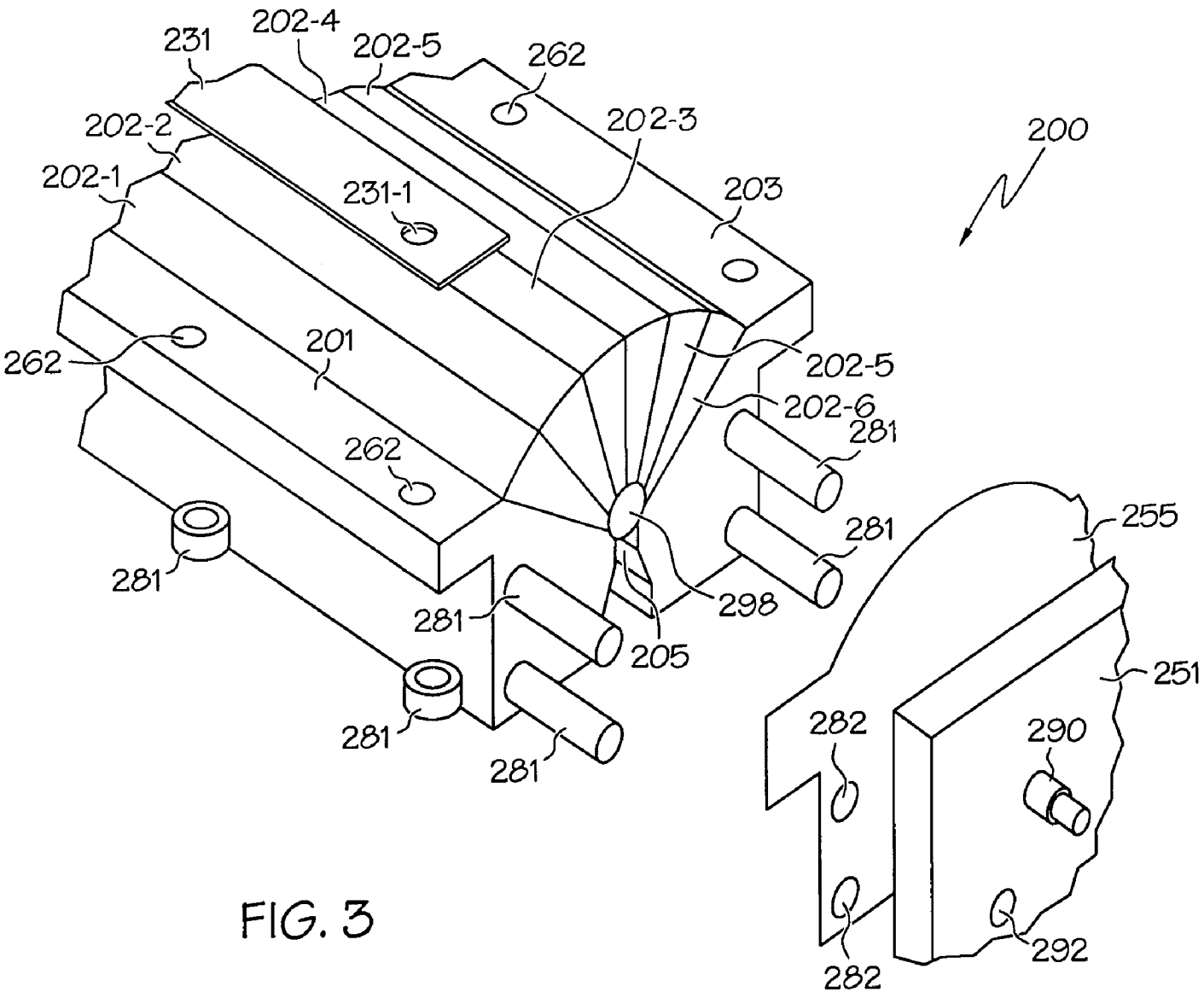
FIG. 3 illustrates further details of the compartmentalization of reactive materials in one aspect of the invention.

FIGS. 2 and 3 show one embodiment of a linear thermite charge design according to the invention. FIG. 2, includes a compartmented unit 202 within a modular unit 200 that allows for quick and easy variation of the shape and area of a cut. Referring again to FIGS. 2 and 3, the compounds necessary to produce the desired reaction will be separated within compartmented unit 202 compartments. This separation of components (e.g., oxidizing compounds and thermite-based fuels) will offer safety in device handling, storage, and transportation. Sidewalls 201, 203 are elongated sides that also form a nozzle 205, and contain the compartmented unit 202 having a plurality of compartments 207, containing oxidizer and fuel. A container top 221 seals the oxidizer and fuel 223, 225 with the aid of gaskets 231, 233. End plates 251, 253 (with four mounting holes 284) and gaskets 255, 257 (with six mounting holes 282) seal the ends of the compartmented linear thermite charge. Bolts (eight in number here) 261 hold the top 221 to sides 201, 203 (using holes 262 in the top 221 and holes 231-1 in the gaskets) and nuts 271, hold end plates 251, 253 in place to the sides 201, 203 with mounting studs 281 through holes 282 and 292 in the gaskets 255, 257 and end plates 251, 253 respectively. Connectors 290 and 292 can provide access and control for pressurization of the powdered materials to expedite flow and/or firing of the combined materials. Greater details of the structure are shown in FIG. 3 below.

Integrated attachment mechanisms (e.g. bolts—not shown) would firmly anchor the device 200 using mounting holes 283 to a target's exterior at any angle. Boosting the thermite reactant with a gas-producing solid will create a high-speed flow of hot particles and gases through a nozzle 205 (typically a linear nozzle). This high-temperature/high-velocity flow will allow metal structures to be defeated in a matter of milliseconds. The invention is useful with homogeneous and non-homogeneous structures including steel and concrete.

The linear design of the present invention integrates the thermite mixture and oxidizing materials into a linear arrangement similar to a linear shaped charge. By careful design and compartmentalization, solid fuels and oxidizers (or gas-producing agents) can be separated inside sealed compartments. Essentially instantaneous thermal activation along the length of the device will produce a uniform, high-velocity linear jet. A linear thermite charge's modular unit design will allow adaptation for a desired geometry and will be easily deployed in the field. As used herein, a linear thermite charge includes straight linear and curvilinear charges. Integrated attachment mechanisms for fixing the device to a target material or structure are preferred. These mechanisms will allow for quick attachment at any angle and will ensure that the device is firmly anchored to the material.

FIG. 3 illustrates further details of the modular unit 200 and the compartmented unit 202 that contains oxidant and fuel. By this separation, fuel and oxidant will not be sensitive to mechanical, thermal, or electrical sources normally encountered during handling. This is especially beneficial when compared to conventional explosive charges, which can be activated accidentally if not handled properly. Significant input energy from an initiation device will be required to activate these devices. The reaction of all the gas producing components will progress in a non-explosive manner from the heat generated from the exothermic reaction of the thermite compounds. The device 200 includes sides 201 and 203 that define a jet nozzle 205 and a reaction chamber 298. Disposed within the sides is a compartmented unit 202 having compartments 202-1, 202-2, 202-3, 202-4, 202-5 and 202-6. Typically alternating compartments will contain fuel and oxidant.

A modular unit design for a linear shaped charge system is preferred. Straight and angled connectors will allow custom sizing and shaping for deployment against specific target needs. The number of standard linear segments that are attached before an angled connector will ultimately determine the size of the breached perimeter. The use of all 45-degree connectors will result in an octagonal shape, and the diameter of the application will depend on the number of straight connectors used per segment. The use of 90-degree connectors will result in square or rectangular breaches.

The device will be attached to a target using an integrated attachment system such as adhesives and/or bolts, which will be designed to adhere to the surfaces that are characteristic of probable targets (e.g., rust, polished, and painted surfaces for metals; concrete or masonry for structures). Each segment will be placed on the target, and the attachment system will be activated once the operator is satisfied with its location. After the attachment of all segments is completed, the system will be ready for firing.

One embodiment includes using secondary anchors, which will be initiated by a firing circuit such as for explosive pinning using a stud gun. These anchors will imbed into the target, and hold each device in place while the thermite jet penetrates the material. An integrated delay system in the firing apparatus can propel the device anchors into the target before the thermite reaction is initiated. These anchors will firmly attach each device to the target to counter the thrust from the thermite jet. This integration also reduces the time and complexity of deploying this cutting apparatus.

After deployment of the anchors, the initiation system will ignite the thermite and other energetics present in the system. It is anticipated that the jet will penetrate a ½ inch thick steel target in less than 1 second. This will allow for swift deployment through the breach into the area of interest for rescue or rapid entry applications, and timeframes conducive to commercial demolition applications. Fire extinguishing materials, which would be injected into the breach after the thermite materials have been expended, can be incorporated into the device designs. This would help to reduce the possibility of igniting a secondary material inside the target.

Fuels and Oxidants

Thermite compounds or materials include mixtures that contain fuel and oxidizer and react to produce large quantities of heat and typically solid reaction products. Thermite mixtures of metals and fuels such as aluminum, zirconium, magnesium, boron or titanium; oxides such as iron oxide, common chemical oxidizers such as nitrates and perchlorates, halogen containing polymers and other gas producing materials, such as fluorocarbon (e.g. polytetrafluoroethylene) are typical. Separate containers of oxygen producing solids within the reaction chamber are also useful for to jet the high temperature fuels, metal oxides and reaction products, and boost the temperature of the metal oxidation.

Thermite materials or compounds also include compounds or materials described above that are provided separately and not mixed. Thus a fuel such as the metals, metal oxides and oxidizers described above may be provided separately in compartments disposed within a thermite charge apparatus. Alternatively, some of the fuel ingredients may be mixed together separately from the oxidizers. The fuel and oxidizer are then mixed when the reaction is initiated. Some thermite materials and compounds include a gas producing material or a gas such as that added or generated oxygen or and oxidant to augment the cutting action of the thermite charge.

A preferred class of chemicals for oxygen augmentation includes that which increases or maximizes the concentration of available oxygen at the onset of thermite combustion and reduces or minimizes any adverse impact on achieving high or maximum temperature and velocity. This class of chemicals includes ones such as potassium permanganate ($KMnO_4$) and potassium ferrate ($K_2FeO_4$). These chemicals appear to have been overlooked as additives to enhance thermite combustion, especially to improve cutting operations.

Figure 4:
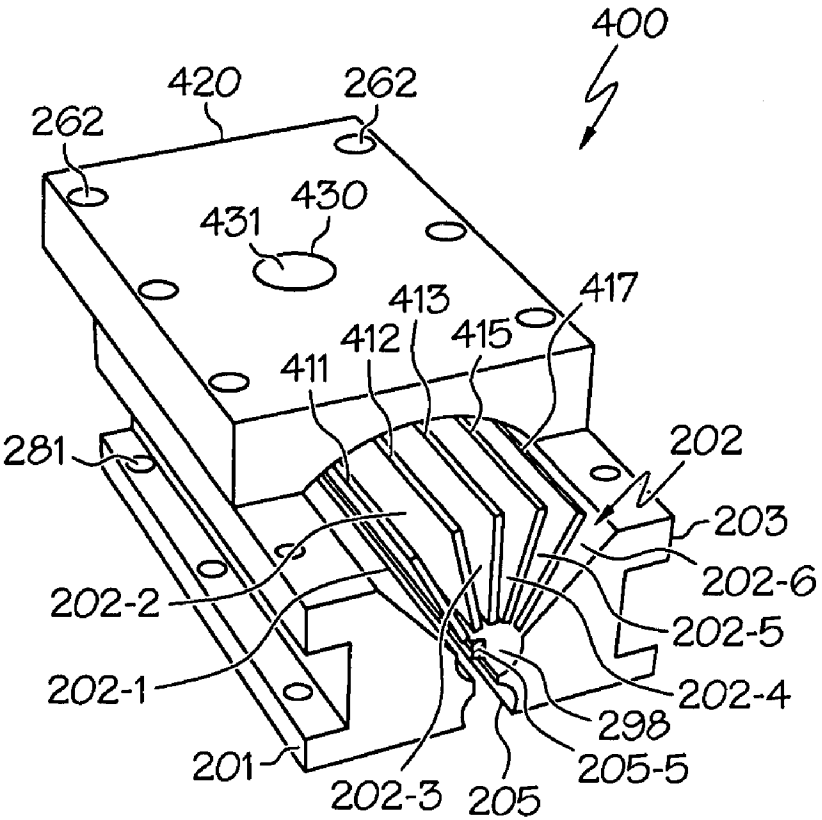
FIG. 4 illustrates further details of the compartmentalization of the device including materials within the compartments.

FIG. 4 illustrates further details of the modular unit 400. Modular unit 400 includes sides 201, 203 within which are enclosed compartmented unit 202 having separators 411, 413, 414, 415, and 417 that are typically metal such as iron, aluminum and the like. Tough ceramics may be used. These separators provide compartments 201-1 through 201-6 for placing materials such as oxidant and/or fuel or other materials that feed into a reaction chamber 298 where the materials from the compartments react to form a jet that emanates from nozzle 205. Typically an initiator 205-5 (e.g. a nichrome wire) is located within or along a side of the reaction chamber 298. Top 420 having mounting holes 262 in one embodiment of the invention has an access hole 430 for pressurization with gas or for containment of an optional pressurized gas initiator 431 (e.g. sodium azide) for generating additional gas pressure during firing of the thermite charge. The additional pressure by gas or by reaction as with sodium azide serves to provide the pressure needed to push the powdered or granulated reactant materials (e.g. fuel, oxidant) form the compartments into the reaction chamber where the initiator 205-5 ignites the resultant mixture. Holes 281 are used for anchoring to a surface to be cut.

Figure 5:
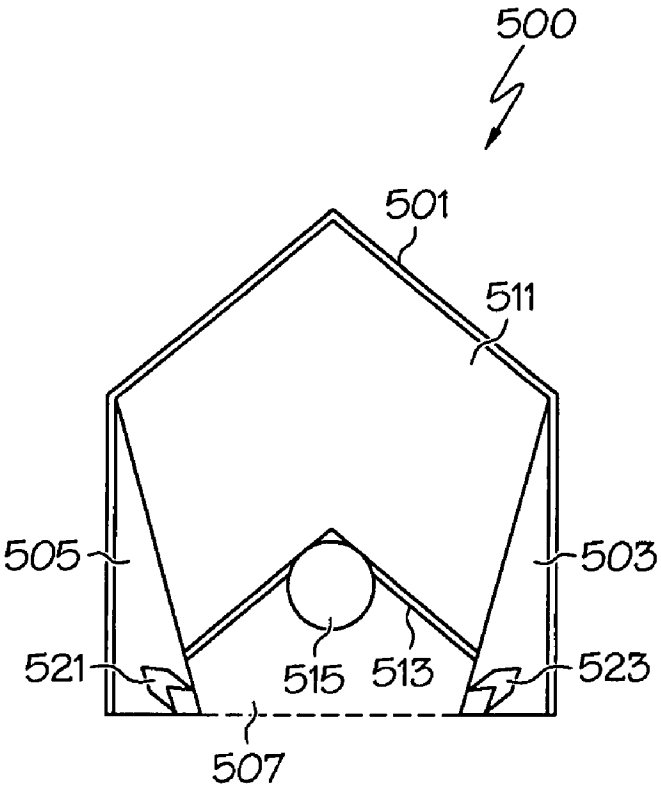
FIG. 5 illustrates another embodiment of a thermite charge including an initiator for firing the device.

Another thermite charge embodiment, illustrated in FIG. 5, shows a linear thermite cutter 500 having an outer liner 501 that encloses a thermite charge 511. Sidewalls 503 and 505 form a nozzle 507. The thermite charge 511 is contained with a barrier 513 prior to use. The barrier breaks down when initiator 515 (e.g. nichrome wire) is activated. As the jet emanates from the nozzle 507 it is augmented by a supplemental oxidant such as oxygen from jet nozzles 521, 523. Typically, the thermite 511 is initiated by the use of a nichrome wire that runs along the apex of the fixture's underside. Integrated jet nozzles are added into the sides of the unit. These nozzles direct gaseous oxygen, or compressed air, from an attached bottle or compressor into the target. The oxygen boosts the reaction temperature of the thermite, and directs the burning particles into the target. The gaseous flow also helps to evacuate burnt material out of the target. If desired the oxygen supply can be augmented or replaced by an oxygen producing reaction within or adjacent to the thermite reaction.

The preferred embodiment of the linear thermite charge is the compartmented oxidizers/fuel described earlier. In this embodiment an integrated solid oxidizer, or gas producer (e.g. pressurized gas initiator 531), allows the gas source to be fully included in the device without the need for connection to external bottles or compressors. This embodiment integrates subsystems that include: separated fuel/oxidizer compartments with the option of field loading of components. For example initiating nichrome wire for the main thermite charge can be used with snap together straight and angle pieces that allow adaptation to a variety of targets and desired shapes. The purpose of this integrated system is to provide for adaptability to targets, allow flexibility for operators, and maximize simplicity of use.

Figure 6:
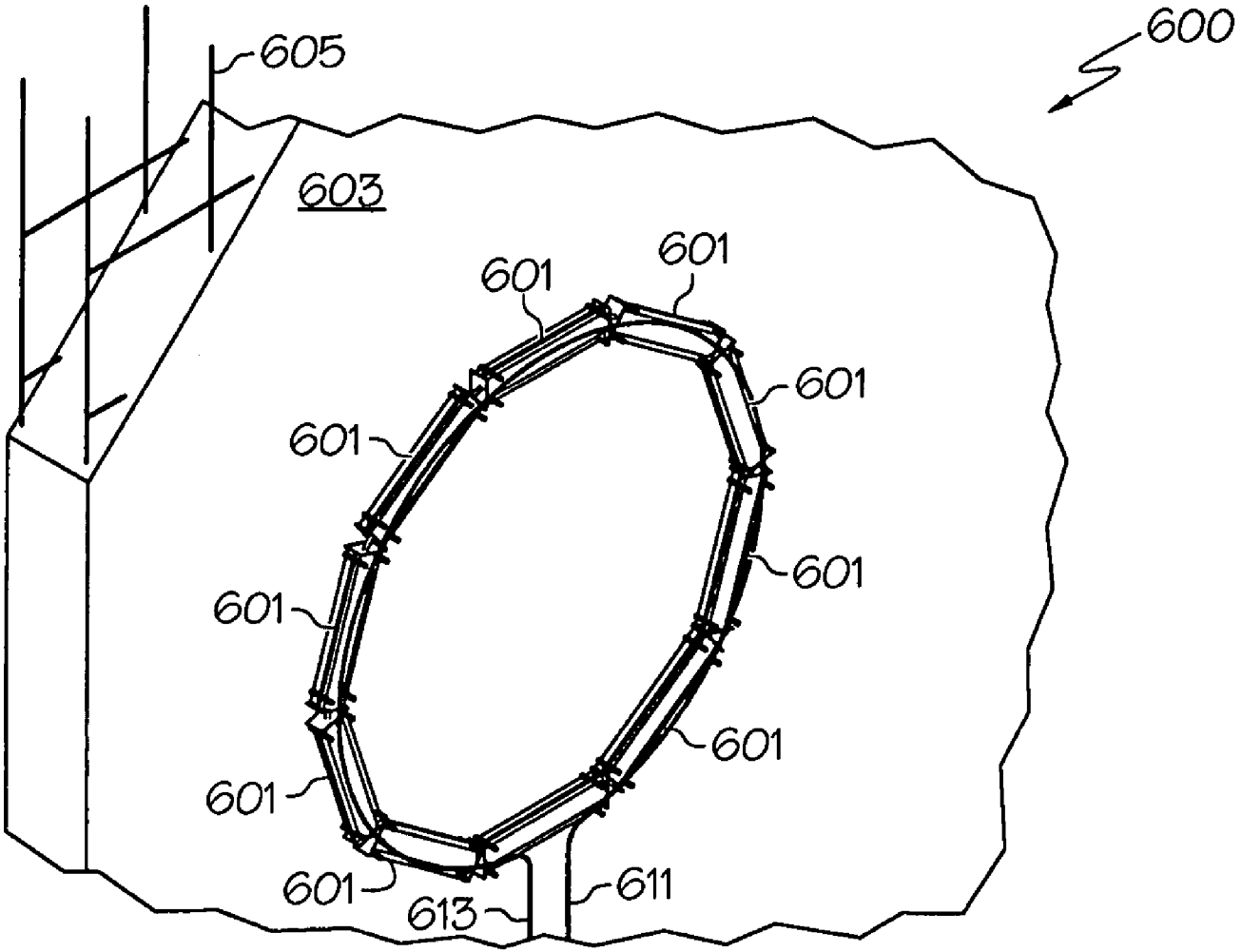
FIG. 6 illustrates yet another embodiment in the form of a thermal charge ring against a reinforced concrete wall.

Referring now to FIG. 6, this figure illustrates a typical deployment 600 of several linear thermite charges 601 on a reinforced concrete wall 603 typically having steel reinforcement 605. The deployment may be any configuration useful for breaching the target including the circular arrangement shown. Firing is through initiator wires 611, 613 that pass through to each linear thermite charge 601.

The separation of fuel and oxidizer components offers advantages in transportation, storage, and handling of the device when compared to explosive based systems. The requirements of a loaded system would adhere to a pyrotechnic hazard rating offering much less stringent regulations than a detonable explosive hazard class. Separate fuel/oxidizer shipments would allow the materials to be classified, shipped, stored and handled as flammable solids and oxidizers before they are loaded into the device at the site of use. This modified "binary" system offers many safety and logistical advantages over explosive systems.

Each fixture can be attached using a stud anchoring mechanism. This mechanism could be stud guns used for military applications and anchoring systems, such as a stud gun, that are prevalent in commercial applications. The stud anchoring system prevents the units from being propelled off the target from the thrust produced from the expulsion of reactant products out of the linear nozzle. The stud anchoring system would be effective for applications against masonry and steel targets.

Separate sections of the device are designed to accommodate variability in target geometry. Angled sections for horizontal variability are designed to close the ends of the individual units for establishing a desired breaching perimeter on a vertical or horizontal surface. These angled sections would include 90° and 60° sections that allow squares, rectangles, hexagons, and trapezoid shapes for cutting. The number of straight sections that are coupled together allows control of the size of the breached area. Angled sections for vertical variability offer adaptation for structural parts that protrude from the cutting plane. Such protrusions could include horizontal or vertical reinforcing beams on a steel wall. These sections allow the apparatus to wrap over such discontinuities. Again, the straight sections allow adaptation to varying lengths of protruding structural parts.

Another embodiment includes a specially shaped ceramic liner for the device. One embodiment focused on a ceramic liner insert for the nozzle. While in another embodiment the metal body provided the majority of the structural support for the fixture, this embodiment relies on the ceramic material itself for strength and vessel integrity. Some ceramic materials have compressive strength in excess of 10,000 psi. This level of material strength is anticipated to be more than adequate for the anticipated stress levels from the reaction of the energetic materials. Certain ceramic materials can also be cast into various shapes and configurations.

The ceramic material is typically lighter than the metals used in the linear thermite charge embodiment. This allows a structurally sound fixture without excess unit weight. Casting also allows easy integration of secondary systems into the fixture. These additional systems can include secondary fixtures for anchoring mechanisms, end configurations for connecting to sequential angle and straight segments, and attachment accommodations for initiation systems, etc. Casting eliminates the expensive alternative of machining parts. The castable ceramic material is also much less expensive per unit weight than metal alternatives.

Figure 7:
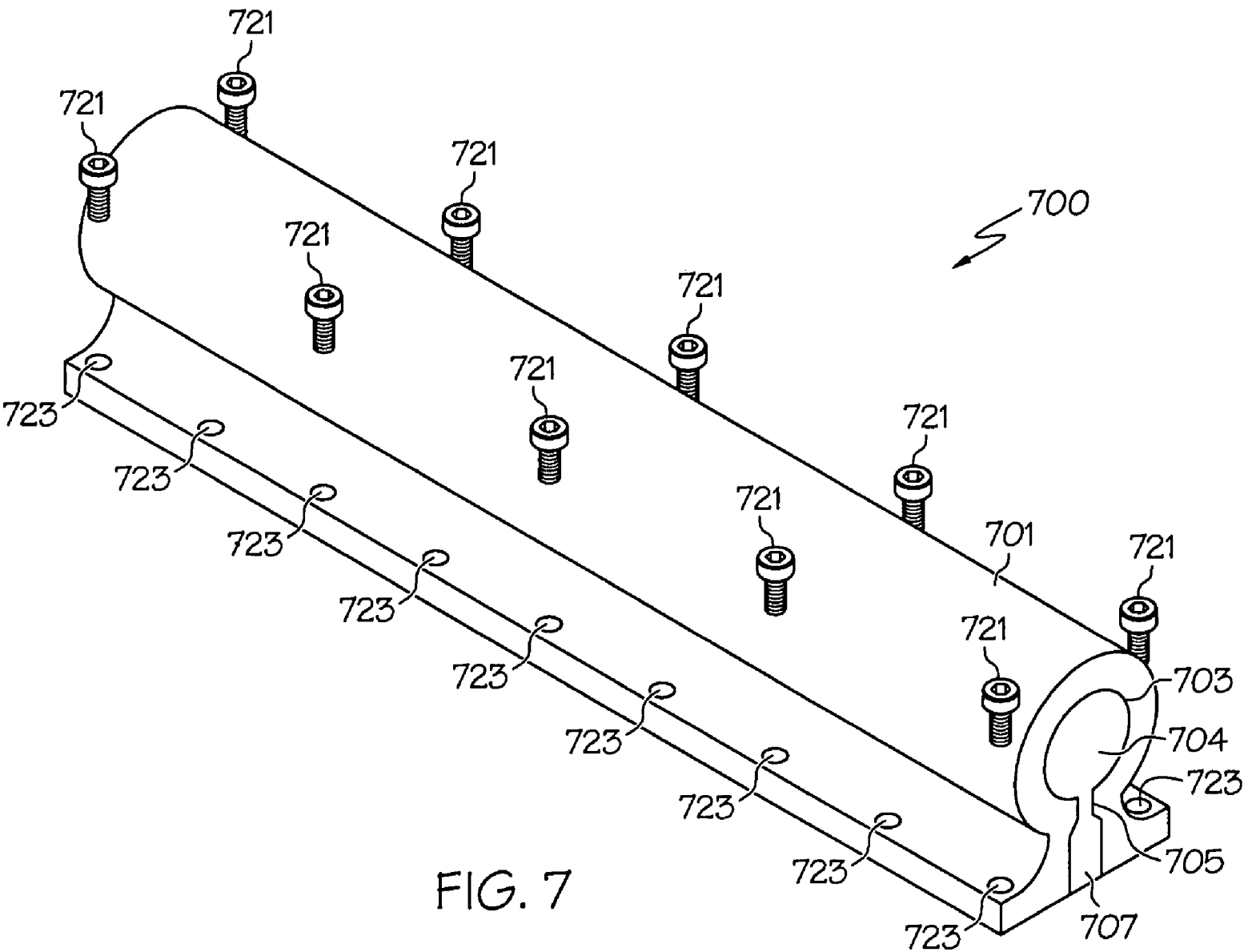
FIG. 7 illustrates another embodiment of the invention that shows a ceramic structure.

Referring now to FIG. 7, this figure illustrates a further embodiment for a cast ceramic device 700 having a ceramic body 701 that encloses a central opening 703 filled with thermite reactant 704 (fuel and oxidant), nozzle throat 705 directs flow and helps form a jet in the lower nozzle 707. Bolts 721 secure the unit to a surface by means of holes 723. The term nozzle as used herein typically includes the throat portion of the nozzle and the nozzle portion below the throat.

Ultimately, a stamped or extruded thin metal or plastic housing may encase the outer perimeter of the ceramic material. This outer casing provides structural integrity and prevents catastrophic failure in case the unit is dropped and the ceramic cracks. The stamped or extruded skin additionally can serve as an exterior mold for casting the ceramic materials.

Figure 8:
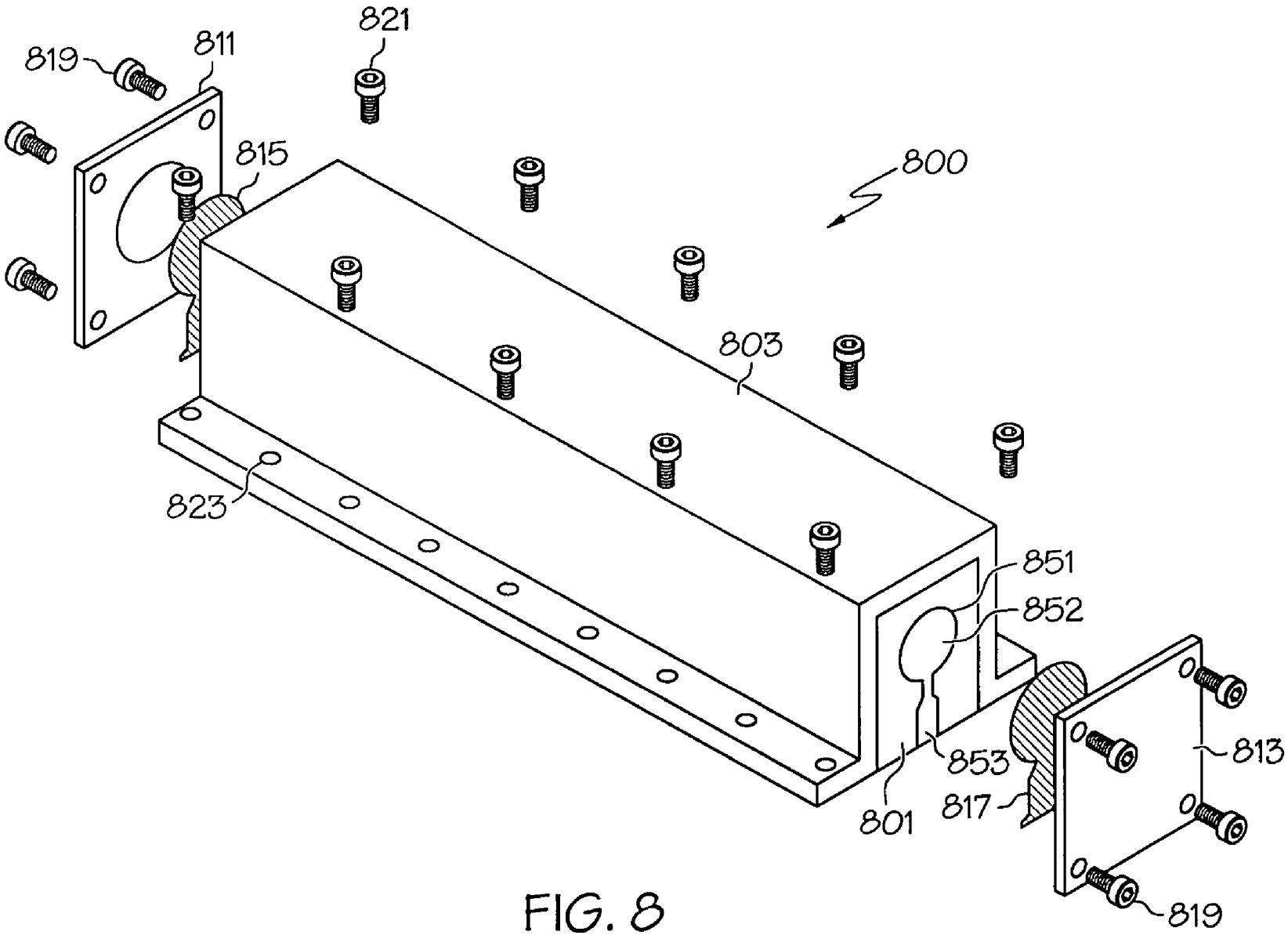
FIG. 8 illustrates yet another embodiment of the invention including a strengthened steel jacket.

Referring now to FIG. 8, this figure illustrates an embodiment 800 having a ceramic housing 801 reinforced by a surrounding metal jacket 803. End plates 811, 813 and gaskets 815, 817 seal the ends with bolts 819. Bolts 821 are used to secure the unit to a surface with holes 823. A volume 851 contains thermite reactants 852. Nozzle 861 is disposed in communication with volume 851 where a thermite cutting jet is formed.

Figure 9:
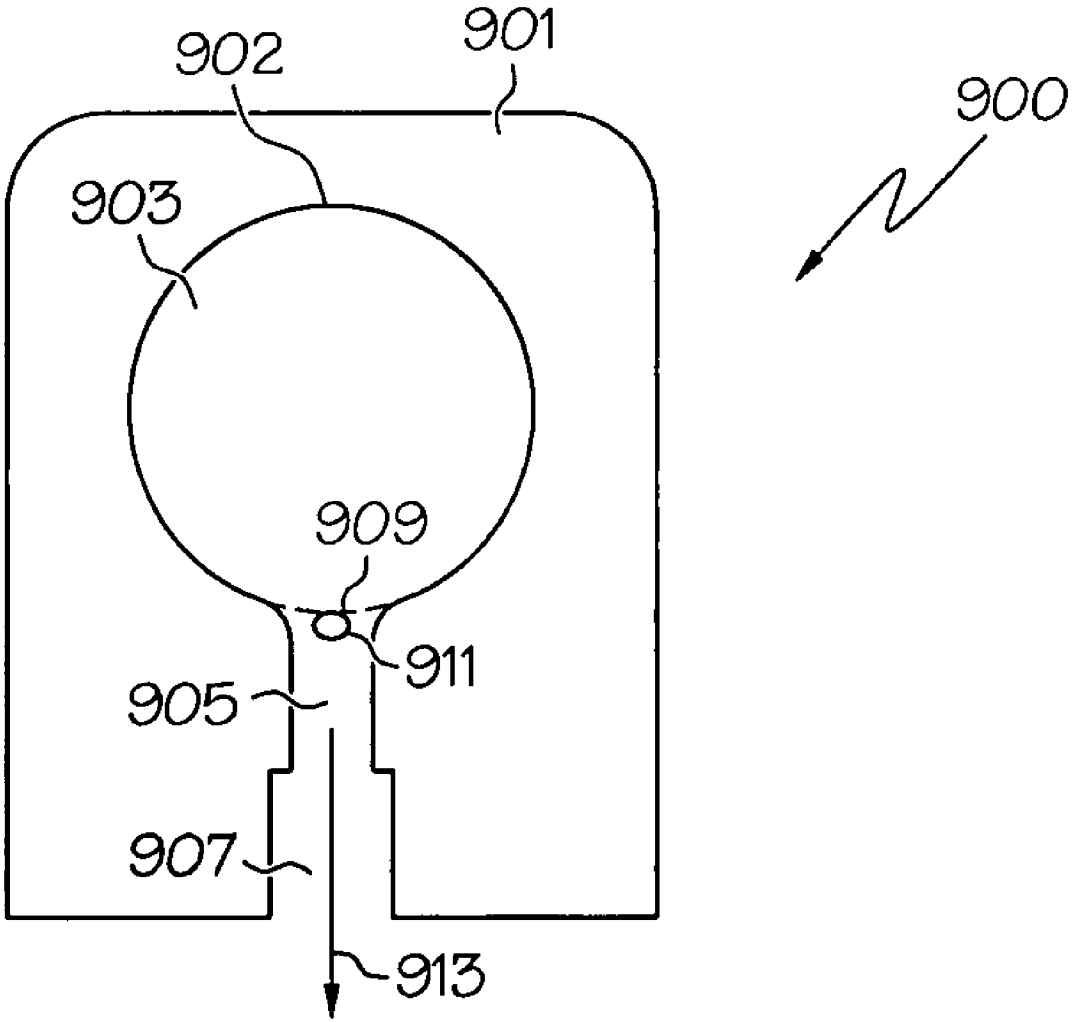
FIG. 9 illustrates a cutaway side view of a thermite charge according to one embodiment of the invention wherein a premixed thermite charge is used.

FIG. 9 illustrates a side view of a typical thermite charge 900 according to another aspect of the invention. A strong material 901 that can withstand the shock and heat of the thermite reaction contains within it a volume 902 filled with thermite reactant 903. The thermite reactant is held by a barrier material 909. Initiator 911 typically runs along one side of the barrier material. A throat 905 forms an outlet from volume 902 as the reaction begins and a jet 913 is formed in nozzle 907.

Figure 10:
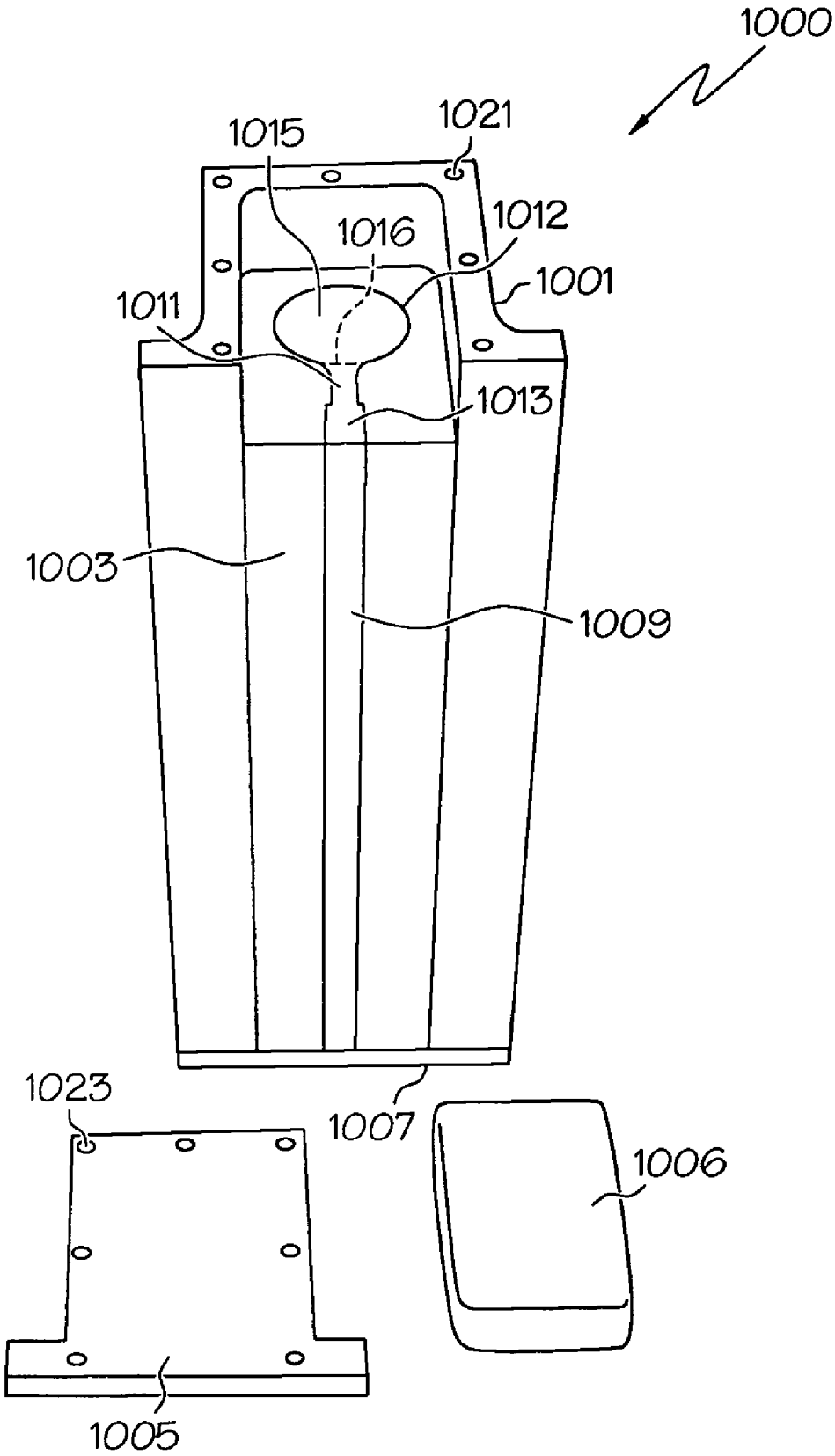
FIG. 10 is an oblique view of an embodiment with a linear thermite charge having an elongated jet.

FIG. 10 illustrates an oblique bottom view of a modular thermite charge 1000. The modular thermite charge 1000 is formed by a casing 1001, that encloses an inner casing 1003. Within inner casing 1003 is a volume 1012 that contains a thermite charge 1015 held in by barrier 1016. The volume 1012, charge 1012, barrier 1016, throat 1011, and nozzle 1013 typically run the length of the inner casing 1003. End walls 1005, 1007, and a gasket 1006 are used to seal the ends of the modular unit 1000. Holes 1021 and 1023 are typically used with fasteners such as bolts. This embodiment produces a long elongated outlet 1009 for the jet.

FIG. 11 illustrates an oblique bottom view of a modular thermite charge 1100. In this unit the long jet outlet 1009 is replaced by a series of shorter jet outlets 1131 that are formed by the addition of spacers 1133 that start at the nozzle outlet 1134 and rise to the barrier 1016. The volume 1012 is left open from one end to the other. When the thermite charge fires the reactions occurs essentially along the entire length of the open volume and individual jets form at each nozzle outlet 1131.

FIG. 12 illustrates an oblique bottom view of a modular thermite charge 1200. In this embodiment a plurality of individual round outlets 1231 formed by either one large charge within the volume 1012 or a series of individual circular thermite charges. In this view thermite charge material 1215 is disposed in volume 1217. Volume 1217 runs the length of the device to the end plate Referring now to FIG. 13, this figure is a schematic drawing of another embodiment of a continuous thermite charge apparatus 1300. Fuel 1301 from fuel source 1302 is supplied via line 1303 to a flow of gas 1305 that is typically compressed air or other gas, where a fuel gas mixture 1308 is formed in manifold 1307 that flows through manifold 1307 to nozzle 1309. Oxidizer 1311 is supplied from oxidizer source 1312 via line 1313 to a flow of gas 1305 that is typically compressed air or other gas, where an oxidant gas mixture 1318 is formed in manifold 1317 that flows through manifold 1317 to nozzle 1309. Nozzle 1309 is contained within a first continuous thermite charge apparatus 1310. Fuel, oxidizer and gases mix in the nozzle 1309 and are reacted by initiator 1321. The reaction forms a continuous thermite jet 1327 that exits the nozzle 1309.

Figure 13:
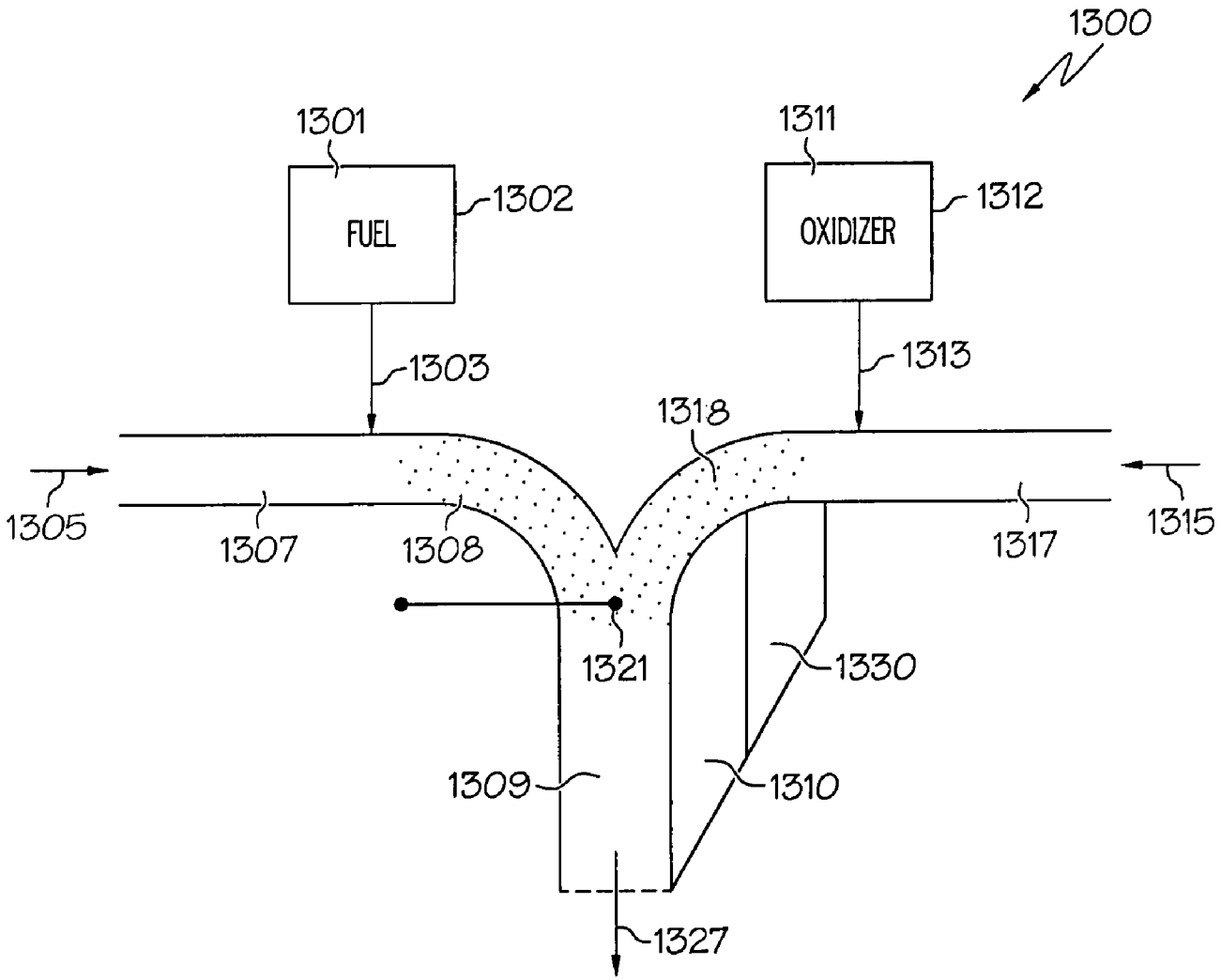
FIG. 13 is a schematic drawing of another embodiment of the invention for mixing one or more thermite compounds with one or more gases for forming a continuous thermite jet.

In another embodiment, the continuous thermite charge apparatus of FIG. 13 has no separate supply of oxidizer 1311. In this embodiment, gas 1305 and/or gas 1315 can serve as the oxidizer. Fuel 1301 and oxidizer 1311 are typically solid powders or granulates.

In a yet further embodiment, the first continuous thermite charge apparatus 1310 of FIG. 13 has one or more continuous thermite charge apparatus 1330 located adjacently. The one or more continuous thermite charge apparatus 1310, 1330 and so on typically form a linear nozzle for cutting materials. The additional continuous thermite charge apparatus 1330 and so on may be supplied from fuel source 1302 or oxidizer source 1312 or may be supplied by other sources (not shown). Having separate fuel and oxidizer sources for continuous thermite charge apparatus 1330 and others allows the tailoring of the cutting jet emanating from the additional units. Thus if the continuous thermite charge apparatus 1310 is used to cut reinforced concrete by moving the unit along a linear cut, the first thermite charge apparatus 1310 can cut the concrete and the second following continuous thermite charge apparatus 1330 can be adjusted (e.g. jet augmentation by potassium permanganate) to cut the rebar in the concrete or a layer below the concrete such as steel.

Applications for the invention include linear cut or curvilinear cuts in homogenous and non-homogeneous materials. Typical cutting operations include: Concrete, and reinforced concrete, in a variety of applications (cut into slabs or rubble); break pavement for a variety of access needs including utilities: gas, electric, phone, cable, water, sewer; street applications including bridge decks and other repair/replacement; road beds in large scale—highway with rebar; concrete in any structure (walls, etc.); demolition—of structures, buildings—steel reinforcing (I-beams in concrete); steel bridges, steel hulls (ships for rescue applications and hostile applications); and general concrete removal.

While the forms of the invention herein disclosed constitute presently preferred embodiments, many others are possible. It is not intended herein to mention all of the possible equivalent forms or ramifications of the invention. It is to be understood that the terms used herein are merely descriptive, rather than limiting, and that various changes may be made without departing from the spirit of the scope of the invention.

We claim:

1. A linear thermite charge apparatus comprising:

a. an elongated casing;

b. an elongated volume within the casing, the elongated volume having a length;

c. a thermite material disposed within the elongated volume, the thermite material having an elongated length;

d. an initiator positioned along the elongated length of the thermite material, the initiator configured to instantaneously activate the elongated thermite material along the length of the thermite material; and e. one or more linear nozzles in communication with the volume and configured to exhaust the activated thermite material.

2. The linear thermite charge according to claim 1, wherein the volume in the elongated casing contains more than one thermite materials.

3. The linear thermite charge according to claim 1, wherein the volume in the elongated casing contains more than two thermite materials.

4. The linear thermite charge according to claim 1, wherein the linear nozzle comprises a plurality of nozzles.

5. The linear thermite charge according to claim 1, wherein potassium permanganate ($KMnO_4$) and/or potassium ferrate ($K_2FeO_4$) are disposed within the volume.

6. The linear thermite charge according to claim 1, further comprising an outer casing that at least partially surrounds the casing.

7. The linear thermite charge according to claim 1, wherein the casing comprises a ceramic.

8. The linear thermite charge according to claim 7, wherein at least one compartment comprises fuel and at least one compartment comprises oxidizer.

9. A linear thermite charge apparatus comprising:

an elongated casing:

an elongated volume within the casing, the elongated volume having a length;

one or more separators within the volume, wherein two or more compartments are formed within the volume;

a thermite material disposed within the compartments formed within the volume, the thermite material having an elongated length, an initiator positioned along the elongated length of the thermite material, the initiator configured to instantaneously activate the elongated thermite material along the length of the thermite material; and one or more linear nozzles in communication with the volume.

10. A thermite charge kit comprising:

a. a plurality of modular linear thermite charges, each thermite charge having an elongated thermite material, each thermite material having a length;

b. connectors for connecting the charges and electrical wiring for firing an initiator disposed in each modular linear thermite charge, each initiator positioned along the length of the elongated thermite material and configured to instantaneously activate the elongated thermite material along the length of the thermite material;

c. mounting mechanisms for mounting the modular linear thermite changes to a surface;

d. stud drivers for mounting the modular linear charges to a surface; and e. an ignition system for firing the modular linear thermite charges with the wiring.

11. A method for cutting a material comprising:

providing a thermite charge comprising;

a. an elongated casing;

b. an elongated volume within the casing, the elongated volume having a length, wherein a thermite material is disposed within the volume, the thermite material having an elongated length;

c. an initiator positioned along the elongated length of the thermite material, the initiator configured to instantaneously activate the elongated thermite material along the length of the thermite material; and d. one or more linear nozzles in communication with the volume;

placing the linear nozzle of the thermite charge against a surface of the material to be cut; and firing the thermite charge to cut the material.

12. The method according to claim 11, wherein a plurality of linear charges are supplied and used to cut the material.

13. The method according to claim 11, wherein the cutting is augmented by potassium permanganate ($KMnO_4$) and/or potassium ferrate ($K_2FeO_4$).

14. The method according to claim 11, wherein the cutting is augmented by pressurized gas.

15. The method according to claim 11, wherein the cutting is augmented by pressurized air.

* * * * *